US007405718B2

(12) United States Patent
Matsuyama

(10) Patent No.: US 7,405,718 B2
(45) Date of Patent: Jul. 29, 2008

(54) DRIVER FOR A LIQUID CRYSTAL DEVICE

(75) Inventor: Shigeru Matsuyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 688 days.

(21) Appl. No.: 10/736,218

(22) Filed: Dec. 15, 2003

(65) Prior Publication Data

US 2004/0196245 A1 Oct. 7, 2004

(30) Foreign Application Priority Data

Dec. 20, 2002 (JP) ..... 2002-370053

(51) Int. Cl.
*G09G 3/36* (2006.01)

(52) U.S. Cl. ..... 345/98; 345/87; 345/100

(58) Field of Classification Search ..... 345/87–100, 345/204

See application file for complete search history.

(56) References Cited

U.S. PATENT DOCUMENTS

| | | | | |
|---|---|---|---|---|
| 5,929,574 | A * | 7/1999 | Kim et al. | 315/370 |
| 6,628,259 | B2 * | 9/2003 | Hashimoto | 345/98 |
| 7,075,505 | B2 * | 7/2006 | Sakaguchi et al. | 345/87 |
| 7,088,324 | B2 * | 8/2006 | Sakaguchi et al. | 345/87 |
| 7,138,973 | B2 * | 11/2006 | Okafuji et al. | 345/98 |
| 2001/0013850 | A1 * | 8/2001 | Sakaguchi et al. | 345/87 |
| 2001/0015712 | A1 * | 8/2001 | Hashimoto | 345/92 |

FOREIGN PATENT DOCUMENTS

| | | |
|---|---|---|
| JP | 57-017996 | 1/1982 |
| JP | 05-297818 | 11/1993 |
| JP | 07-134562 | 5/1995 |
| JP | 09-090896 | 4/1997 |
| JP | 2002-040979 | 2/2002 |
| JP | 2004-133124 | 4/2004 |

* cited by examiner

*Primary Examiner*—Richard Hjerpe
*Assistant Examiner*—Kimnhung Nguyen
(74) *Attorney, Agent, or Firm*—Hogan & Hartson LLP

(57) ABSTRACT

A driver for a liquid crystal device includes a plurality of common drivers having a first common driver and a last common driver for comb-like driving that is coupled in cascade connection and a frequency divider that produces a second clock for interlaced driving by halving a period of a first clock that is provided from outside for serving as a basis of driving the drivers regarding each of the common drivers for comb-like driving aside from the first common driver and the last common driver. A converter circuit converts two periods of output data that are output in response to input data corresponding to one period of the first clock into one period of output data by using the second clock regarding input and output data of each of the common drivers for comb-like driving.

6 Claims, 14 Drawing Sheets

DRIVER FOR A LIQUID CRYSTAL DEVICE

BACKGROUND OF THE INVENTION

1. Field of the Invention

The present invention relates to a driver for a liquid crystal device, and more particularly to a driver for a liquid crystal device that is used with multiple common drivers for comb-like driving in cascade connection.

2. Description of Related Art

Mobile devices such as cellular phones have been widely used in recent years. Liquid crystal display (hereinafter called LCD) panels for such mobile devices, in particular cellular phones, employ simple matrix display, active matrix display, or other technologies. Simple matrix display technology turns pixels on with electrodes placed lengthwise and crosswise of a display, while active matrix display technology turns each element forming a pixel on and off.

More specifically, active matrix display technology includes thin-film transistor (TFT) display technology, which uses transistors incorporated in each pixel, and thin-film diode (TFD) display technology, which uses diodes incorporated in each pixel. Among other things, TFD display technology provides as wide a range of contrast and colors as TFT display technology for representing moving images and natural colors with low power consumption. Thus TFD display technology is expected to be widely used for cellular phones and other devices in the near future.

When an LCD panel utilizing one of the above-mentioned display technologies is mounted on a mobile device, particularly on a cellular phone, the size (in particular, the width) of its outer case is almost predetermined. Therefore, if a segment driver (or an X driver, hereinafter referred to as a SEG driver) that is coupled to a segment electrode of the LCD panel and a common driver (or a Y driver, hereinafter referred to as a COM driver) that is coupled to a common electrode are put together with the LCD panel in the case, the SEG driver is placed below the LCD panel, while the COM driver is placed to the left or right of the LCD panel. As a result, the display of the LCD panel is placed to the left or right from the center of the case.

To solve this problem, the COM driver that is originally placed to the left or right of the LCD panel is usually divided into two to be placed at both sides of the SEG driver (that is, placed to the left and right of the SEG driver) below the LCD panel. Thus the SEG and COM drivers for driving the LCD panel are placed below the LCD panel, while no driver is placed on the other three sides of the LCD panel. Consequently, the LCD panel is placed on the center of the case without tilting to the left or right.

For driving such an LCD panel whose COM driver is divided into two, the following two methods can be used. One is, as shown in FIG. 10, coupling a first COM driver Y1 and a second COM driver Y2 in cascade connection, sending input data from a SEG driver X to the first COM driver Y1, and thereby driving each shift register circuit in the first and second COM drivers Y1 and Y2 sequentially so as to drive an LCD panel line by line from the top to the bottom. The other is, as shown in FIG. 11, scanning the LCD panel alternately from the right and left in a comb-like manner. Here, the latter is defined as comb-like driving.

In this comb-like driving method, the first and second COM drivers Y1 and Y2 conduct a line scan alternately from the right and left on an LCD panel. The same input data are simultaneously input from the SEG driver X to the first and second COM drivers Y1 and Y2. Moreover, by providing data that define scanning of the second COM driver Y2 follows scanning of the first COM driver Y1, each of the first and second COM drivers Y1 and Y2 alternately drives scanning lines sequentially from the top to the bottom as shown in FIG. 11 (starting from line one to lines two, three, four, etc.).

The first and second COM drivers Y1 and Y2 for comb-like driving that drive an LCD panel in a comb-like manner may be coupled in cascade connection for consecutive driving as shown in FIG. 12. This enables the first and second COM drivers Y1 and Y2 for comb-like driving to operate in cascade connection, which can enhance their utility as a driver integrated circuit on the whole.

However, multiple common drivers for comb-like driving in cascade connection involve the following problem. The problem is described below with reference to FIGS. 13 to 15.

FIG. 13 shows the first and second COM drivers Y1 and Y2 for comb-like driving in cascade connection. FIG. 14 shows input and output data, a clock signal, and shift register outputs O1 to O60 of the first COM driver Y1, while FIG. 15 shows input and output data, a clock signal, and shift register outputs O1' to O60' of the second COM driver Y2. It should be noted that external output data DYO (A) from the first COM driver Y1 is input data DYI (B) for the second COM driver Y2, and the timing of the external output data DYO (A) shown in FIG. 14 is identical to the timing of the input data DYI (B) shown in FIG. 15. Although FIGS. 14 and 15 should be put together in a drawing in chronological order, they are shown separately due to space limitations. Here, the first and second COM drivers Y1 and Y2 each include a built-in shift register circuit having sixty flip-flops. The drawings show an example of the common line of each driver with sixty outputs.

Each of the COM drivers for comb-like driving produces a clock (hereinafter called an internal signal XINH) for interlaced driving by halving a period of a basic clock (hereinafter called an external signal YSCL) provided from outside for driving the drivers. Then the drivers reduce the external signal YSCL by one period with the internal signal XINH so as to produce a reduced clock (hereinafter called an internal signal YSCL), which enables the drivers to conduct comb-like driving.

In the first COM driver Y1 shown in FIGS. 13 and 14, DYI (A) represents input data (triggering the first COM driver Y1 and corresponding to one period of the external signal YSCL) that is input to the first COM driver Y1 from a SEG driver not shown in the drawings, and DYO (A) represents output data (showing an end of operations of a period of the shift register) of the first COM driver Y1. The output data DYO (A) from the first COM driver Y1 are sent to the second COM driver Y2, so as to serve as the input data DYI (B) of the second COM driver Y2.

The sixty flip-flops included in the built-in shift register circuit of the first COM driver Y1 for comb-like driving provide outputs O1 to O60 corresponding to two periods of the external signal YSCL as data for scanning each common line (Nos. 1 to 60) based on the input data DYI (A) corresponding to one period of the external signal YSCL. The flip-flops also provide the output data DYO (A) by two periods of the external signal YSCL.

As shown in FIGS. 13 and 15, the output data DYO (A) from the first COM driver Y1 and corresponding to two periods of the external signal YSCL are sent to the second COM driver Y2, so as to serve as the input data DYI (B) of the second COM driver Y2 for comb-like driving. As a result, the sixty flip-flops included in the built-in shift register circuit of the second COM driver Y2 for comb-like driving provide outputs O1' to O60' corresponding to four periods of the external signal YSCL as data for scanning each common line (Nos. 61 to 120) based on the input data DYI (B) corresponding to two periods of the external signal YSCL. The flip-flops also provide output data DYO (B) corresponding to four periods of the external signal YSCL.

However, multiple COM drivers for comb-like driving in cascade connection used as described above involve the following problem. The output data DYO (A) from the first COM driver Y1 for comb-like driving are output by two periods of the external signal YSCL, which is a basic clock provided from outside for driving the drivers. This hinders intended operations of the second COM drivers for comb-like driving in cascade connection.

To put it differently, when the first and second COM drivers Y1 and Y2 for comb-like driving in cascade connection scan lines as shown in FIG. 12, the scanning data of two periods output from the built-in flip-flops make the drivers scan every two lines as intended in the upper half of the LCD panel in the same manner as comb-like driving shown in FIG. 11. However, in the lower half the scanning data of four periods output from the built-in flip-flops make the drivers scan two lines simultaneously with a one-line interval. Consequently, two lines are active at a time, which doubles energy consumption of a driver integrated circuit on the whole.

In consideration of the above-mentioned problem, the invention aims to provide a driver for a liquid crystal device that not only can operate the second and following COM drivers normally in using multiple COM drivers for comb-like driving in cascade connection, but also can reduce energy consumption.

SUMMARY OF THE INVENTION

A driver for a liquid crystal device according to the invention includes a plurality of COM drivers for comb-like driving that is coupled in cascade connection. The driver for a liquid crystal device also includes a means for turning the time length of output data back to that of input data as regards each of the COM drivers for comb-like driving aside from the first and last COM drivers by using a second clock for interlaced driving that is obtained by halving a period of a first clock that serves as a basis of driving the drivers.

This structure prevents, when using multiple COM drivers for comb-like driving in cascade connection, the output data of each COM driver from being passed to the next COM driver in a state that the time length of the output data is doubled to that of input data. It also enables the second and following COM drivers to operate normally. Consequently, it also reduces energy consumption.

Furthermore, a driver for a liquid crystal device according to the invention includes a plurality of COM drivers for comb-like driving that is coupled in cascade connection. The driver for a liquid crystal device also includes a means for producing a second clock for interlaced driving by halving a period of a first clock that is provided from outside for serving as a basis of driving the drivers as regards each of the COM drivers for comb-like driving aside from first and last COM drivers. The driver for a liquid crystal device also includes a means for converting two periods of output data that are output in response to input data corresponding to one period of the first clock into one period of output data by using the second clock as regards input and output data of each of the COM drivers for comb-like driving.

This structure prevents, when using multiple COM drivers for comb-like driving in cascade connection, the output data of each COM driver from being passed to the next COM driver in a state that the time length of the output data is doubled to that of input data. It also enables the second and following COM drivers to operate normally. Consequently, it also reduces energy consumption.

Furthermore, according to the invention, it is preferable that the means for converting output data includes a circuit where the second clock for interlaced driving and two periods of the output data of each of the COM drivers for comb-like driving are input and the circuit performs logical operations with these two inputs.

This structure makes it possible, when using multiple COM drivers for comb-like driving in cascade connection, to turn two periods of a basic clock that is output conventionally as the output data from the first COM driver for comb-like driving back to one period of a clock only by adding simple converting circuits, for example, two inverters and a NAND gate circuit, to the second and following COM drivers for comb-like driving. This enables the second and following COM drivers to operate normally.

DETAILED DESCRIPTION OF THE PREFERRED EMBODIMENTS

Embodiments of the invention are described below with reference to the accompanying drawings.

Figure 1:
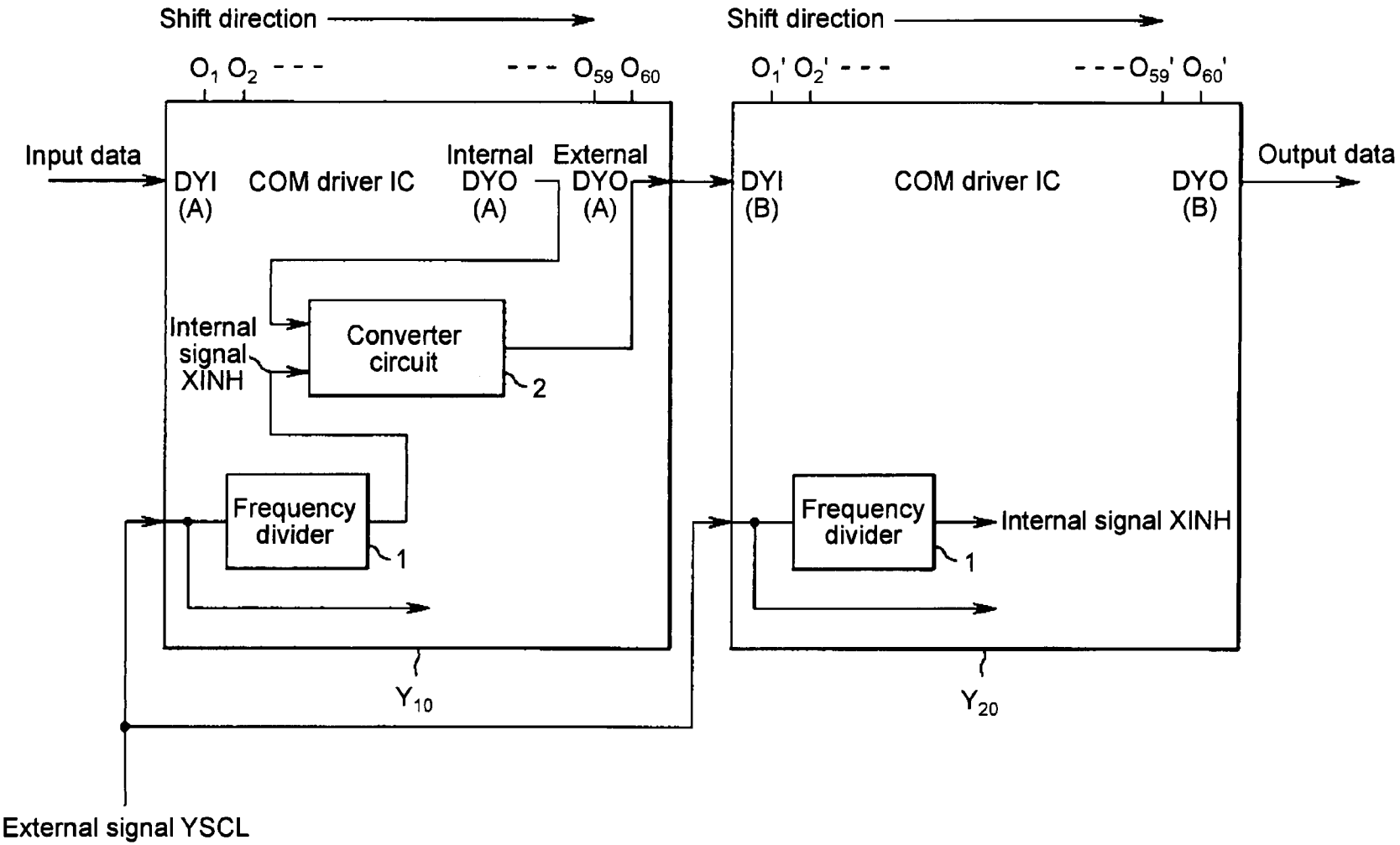
FIG. 1 is a block diagram showing a driver for a liquid crystal device according to an embodiment of the present invention.

FIG. 1 is a block diagram showing a driver for a liquid crystal device according to an embodiment of the present invention.

Figure 10:
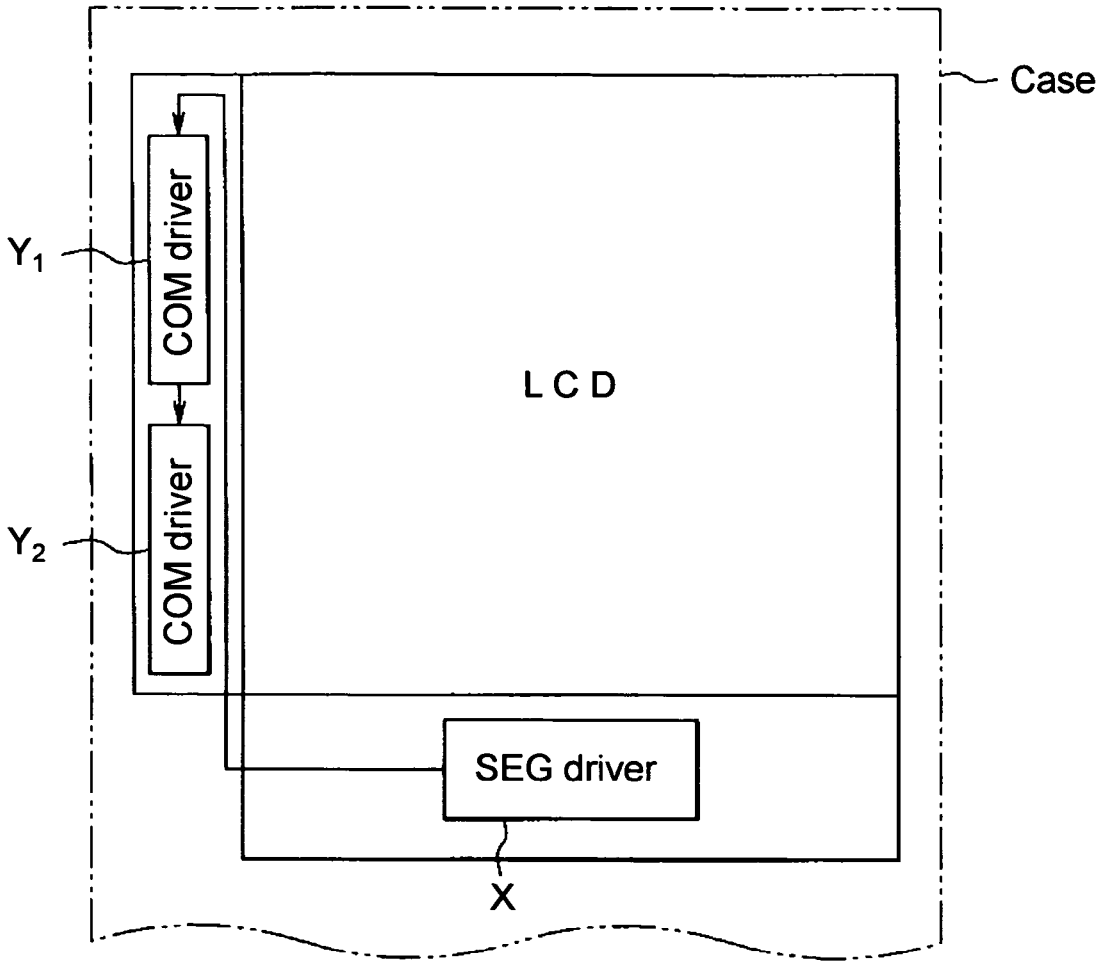
FIG. 10 is a diagram illustrating an example of a way to drive an LCD panel.
Figure 11:
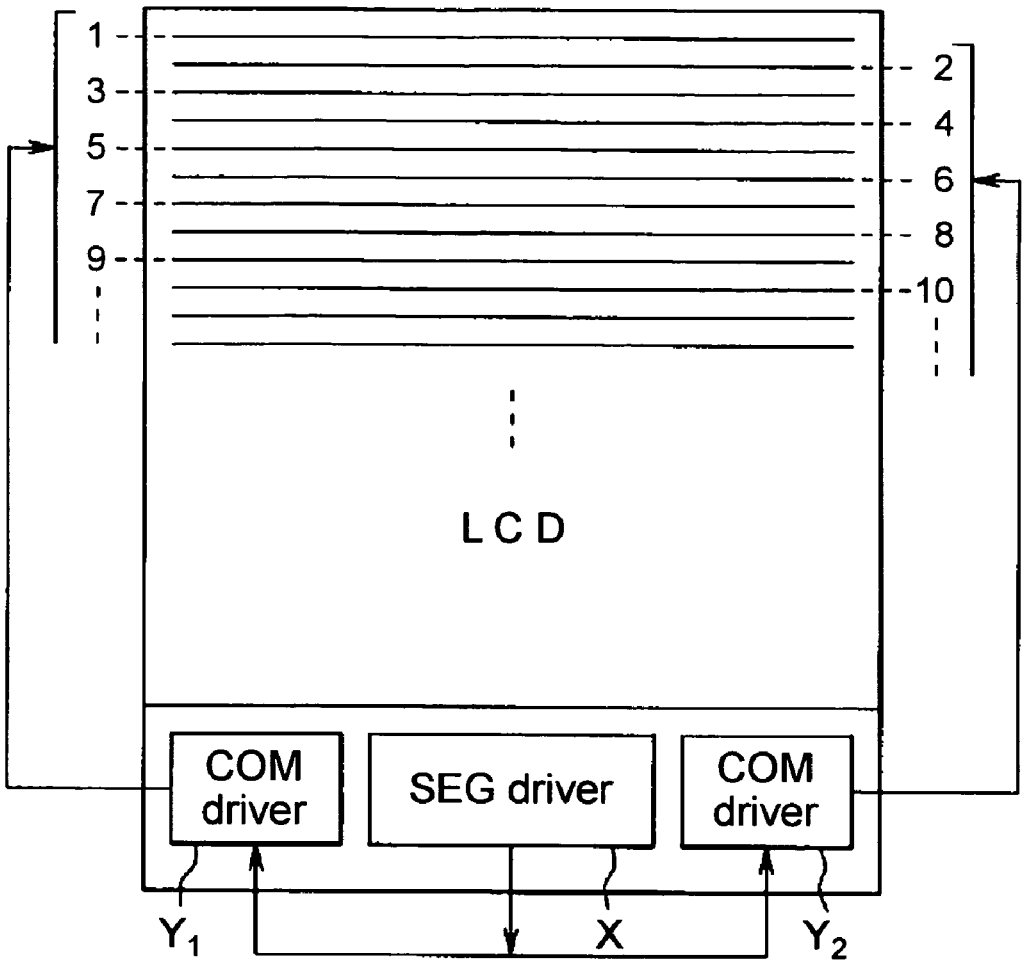
FIG. 11 is a diagram illustrating a way to drive an LCD panel in a comb-like manner.
Figure 12:
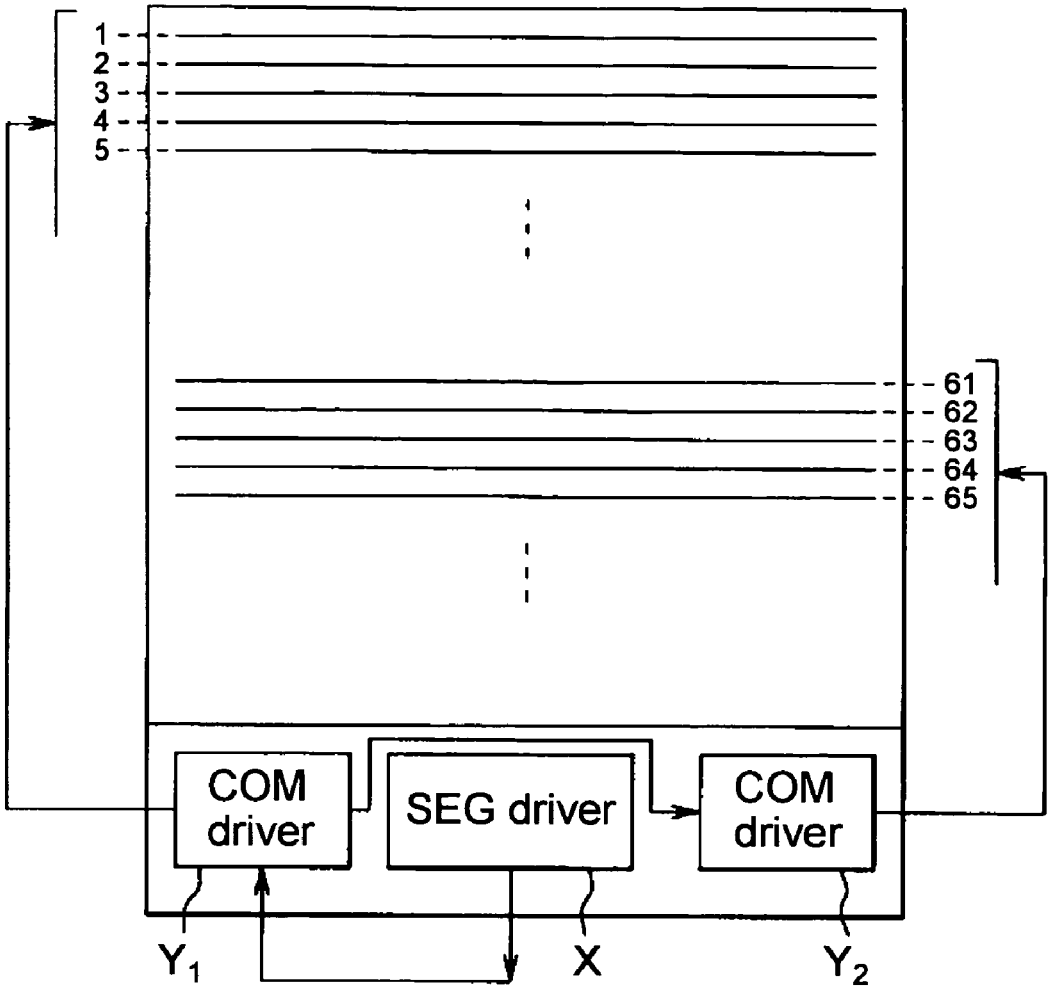
FIG. 12 is a diagram illustrating a way to drive the COM drivers Y1 and Y2 for comb-like driving in cascade connection.
Figure 13:
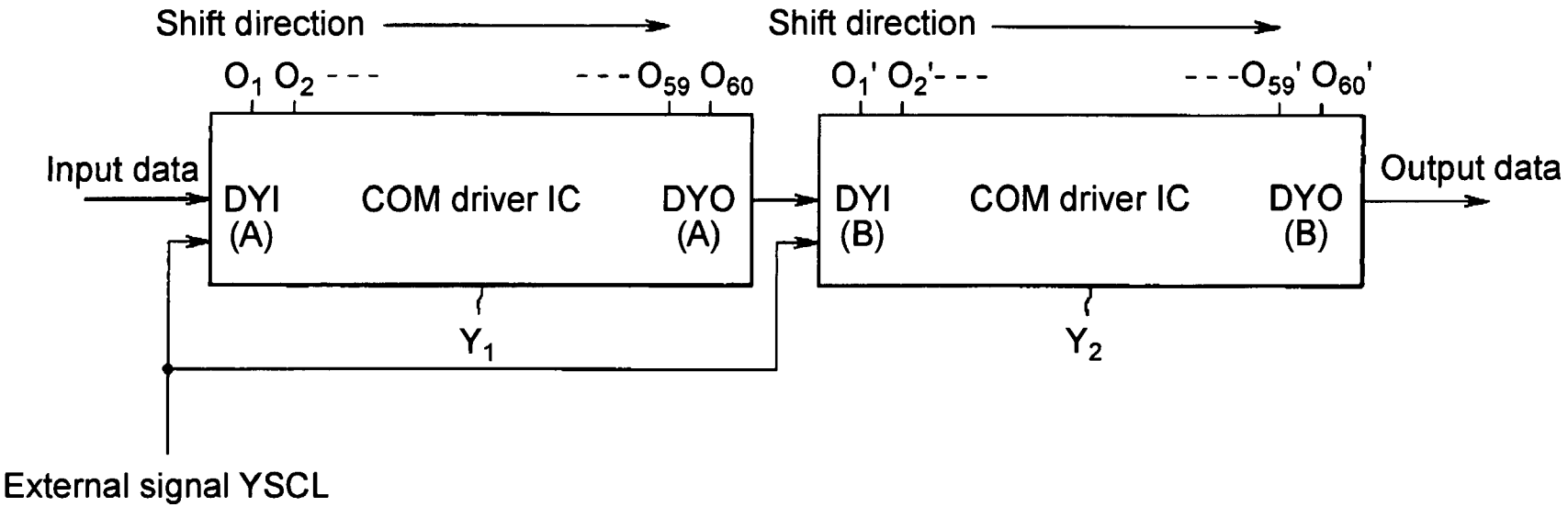
FIG. 13 is a block diagram showing the COM drivers Y1 and Y2 for comb-like driving in cascade connection.
Figure 14:
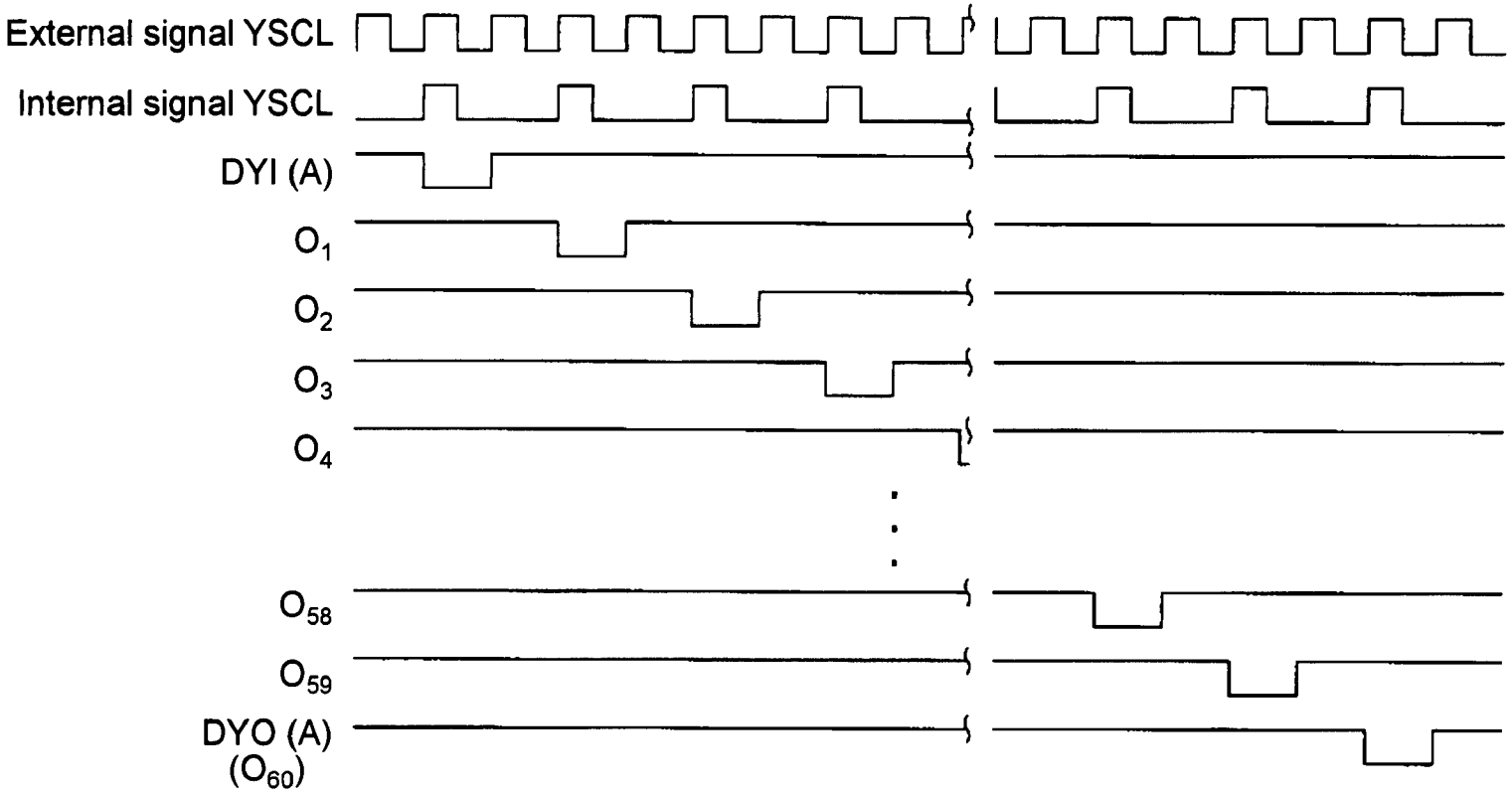
FIG. 14 is a timing chart showing input and output data, a clock signal, and shift register outputs O1 to O60 of the first COM driver Y1.
Figure 15:
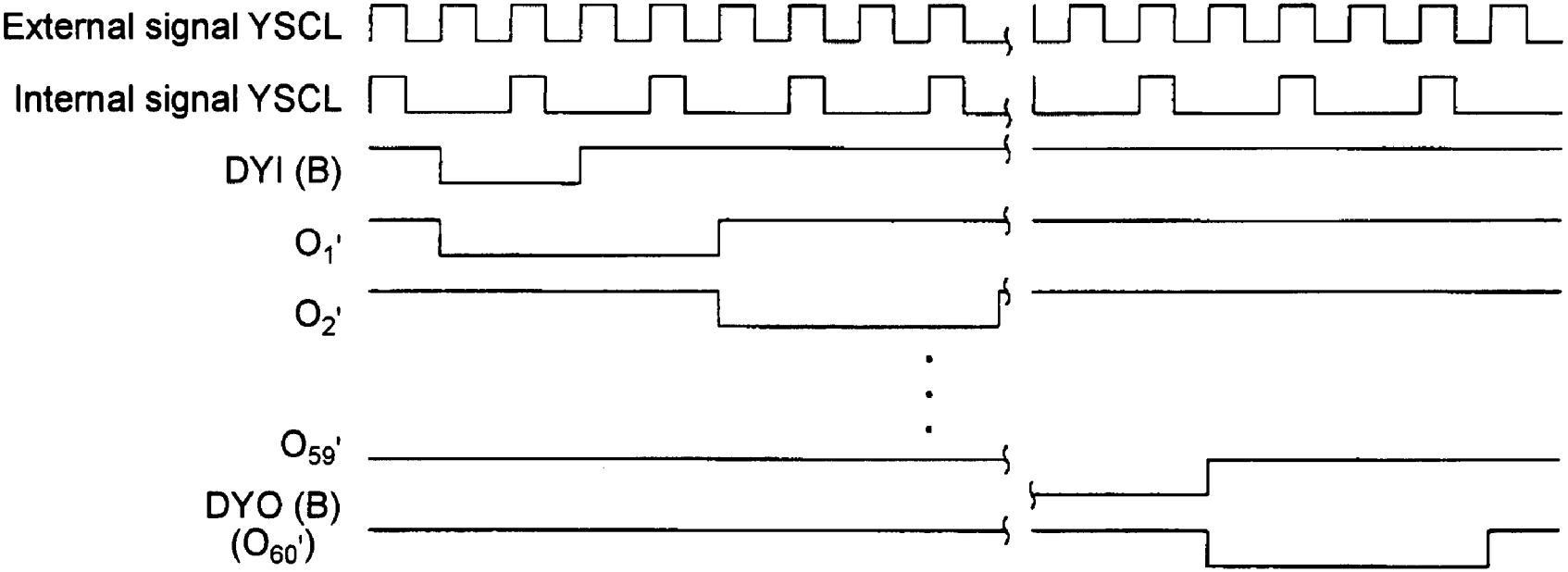
FIG. 15 is a timing chart showing input and output data, a clock signal, and shift register outputs O1' to O60' of the second COM driver Y2.

The driver for a liquid crystal device shown in FIG. 1 includes a plurality of COM drivers (two of them, the first and second COM drivers Y10 and Y20, are shown in the drawing) for comb-like driving in cascade connection as illustrated in FIG. 10 or FIG. 12.

Each of the first and second COM drivers Y10 and Y20 for comb-like driving includes a built-in shift register circuit (not shown in the drawing) having a predetermined number (sixty in the drawing) of flip-flops. More specifically, the first COM driver Y10 for comb-like driving includes sixty shift register outputs O1 to O60, while the second COM driver Y20 for comb-like driving includes sixty shift register outputs O1' to O60'.

Each of the first and second COM drivers Y10 and Y20 for comb-like driving further includes a frequency divider 1. The frequency divider 1 receives the external signal YSCL that is a first clock provided from outside for serving as a basis of driving the drivers and produces the internal signal XINH that is a second clock for interlaced driving by halving a period of the external signal YSCL.

The first COM driver Y10 for comb-like driving further includes a converter circuit 2. The converter circuit 2 turns two periods of output data that are output in response to input data corresponding to one period of the external signal YSCL back to one period of output data with the internal signal XINH, which is the second clock.

In other words, when using multiple COM drivers for comb-like driving in cascade connection, this structure prevents the output data of each COM driver aside from the first and last ones from being passed to the next COM driver in a state that the time length of the output data is doubled to that of input data.

Figure 2:
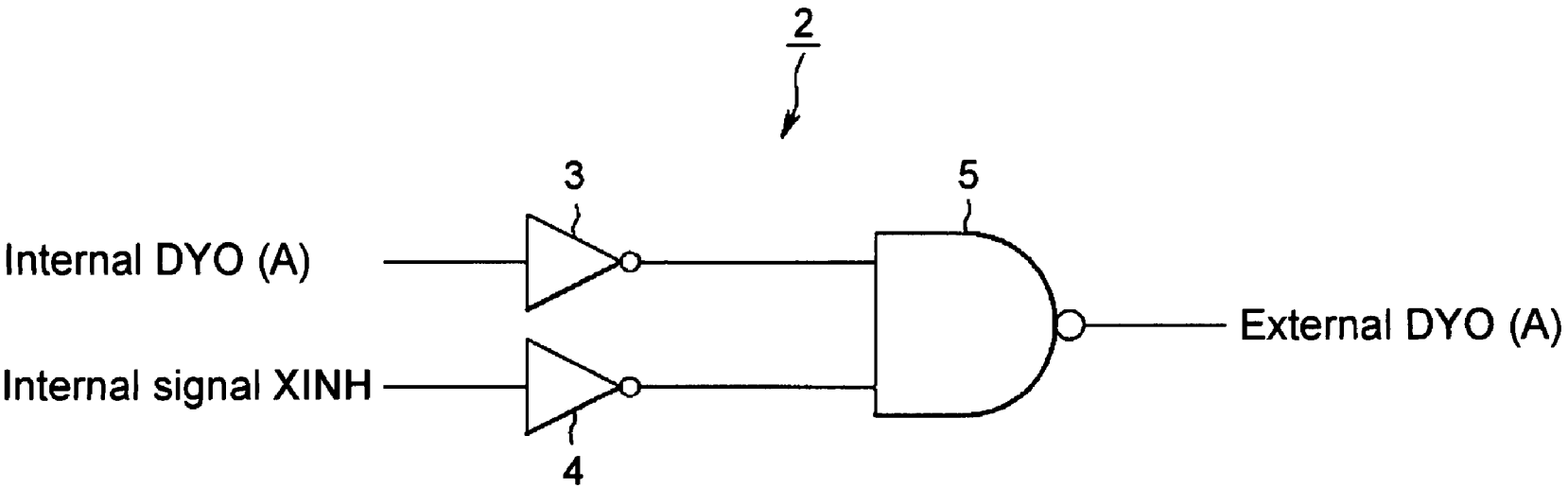
FIG. 2 is a logic circuit diagram illustrating an example of the structure of the converter circuit 2 shown in FIG. 1.

FIG. 2 shows an example of the structure of the converter circuit 2.

The converter circuit 2 performs logical operations by inputting a signal obtained by inverting the internal signal XINH, which is the second clock for interlaced driving, through an inverter 3, and a signal obtained by inverting the output data (just before being output, hereinafter called internal output data DYO (A)) from the first COM driver Y10 for comb-like driving through an inverter 4, to a NAND gate circuit 5 that takes two inputs. Thus, the converter circuit 2 converts two periods of the internal output data DYO (A) to one period of output data (hereinafter referred to as external output data DYO (A)).

This structure makes it possible to turn two periods of the output data of the first COM driver Y10 back to one period of output data only by additionally using simple circuits, for example, two inverters and a NAND gate circuit. It also enables the second and following COM drivers to operate normally only by additionally using such circuits.

Figure 3:
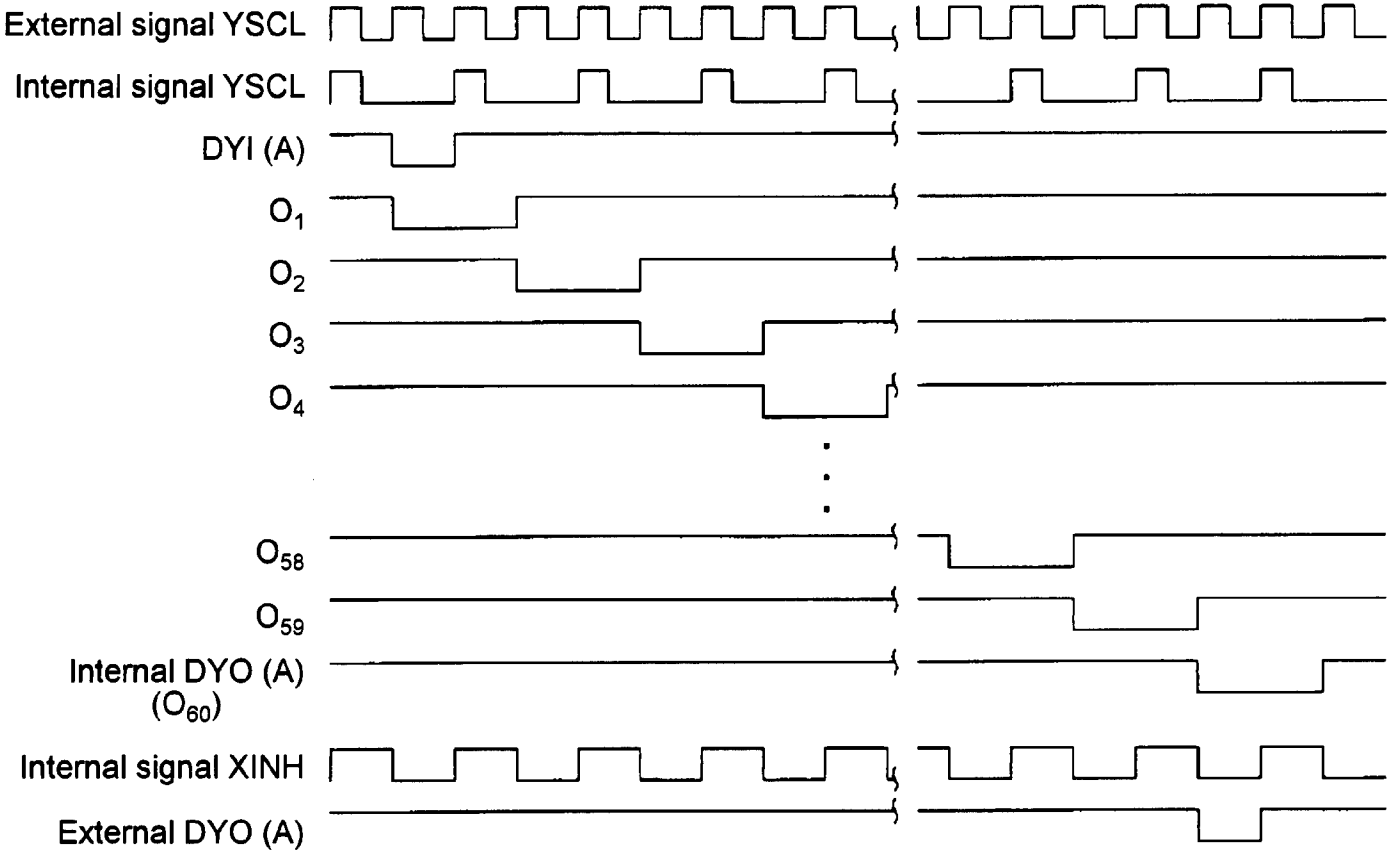
FIG. 3 is a timing chart of each signal of the first COM driver Y10 for comb-like driving.
Figure 4:
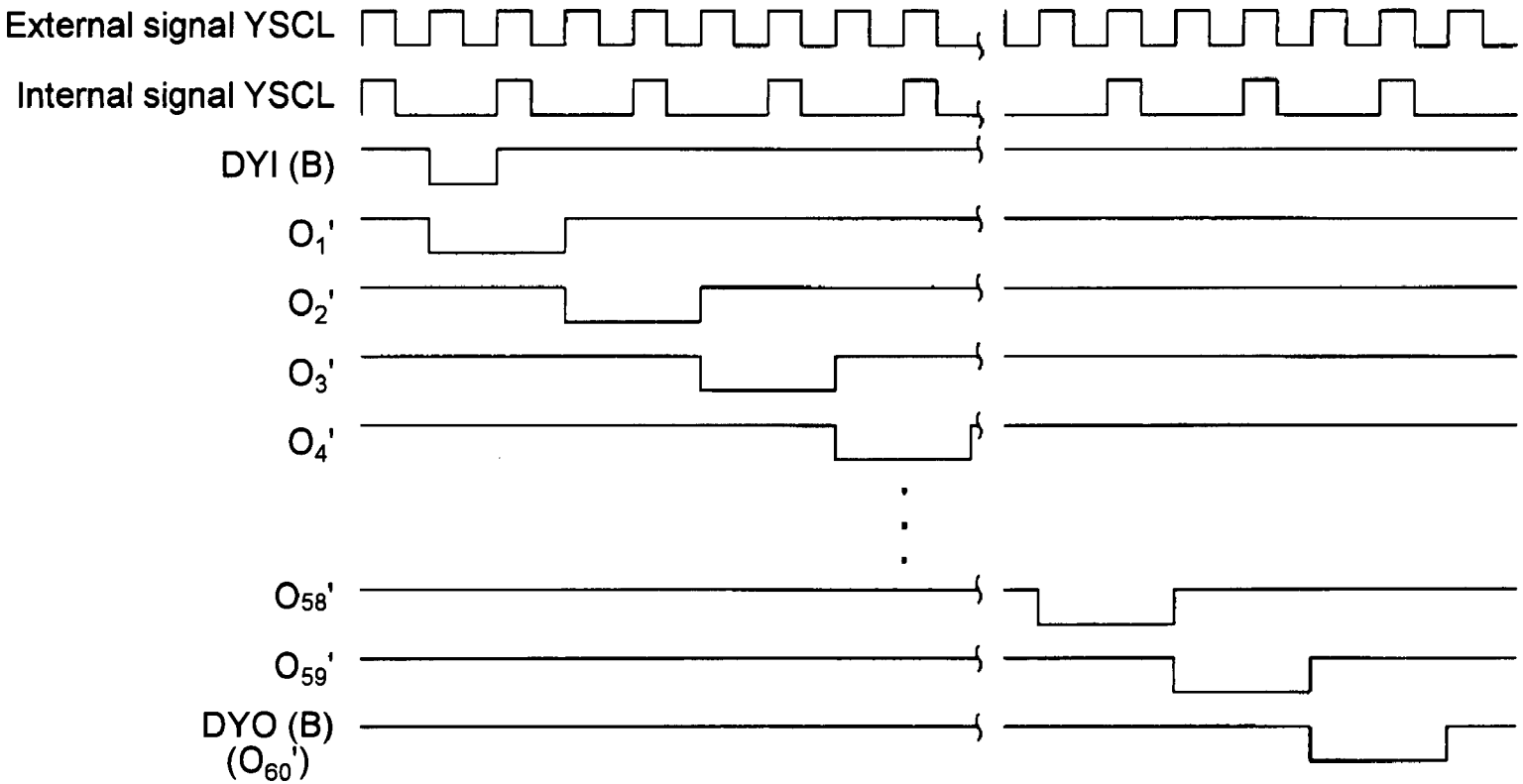
FIG. 4 is a timing chart of each signal of the second COM driver Y10 for comb-like driving.

FIG. 3 is a timing chart of each signal of the first COM driver Y10 for comb-like driving. FIG. 4 is a timing chart of each signal of the second COM driver Y20 for comb-like driving. It should be noted that the external output data DYO (A) from the first COM driver Y10 is the input data DYI (B) for the second COM driver Y20, and the timing of the external output data DYO (A) shown in FIG. 3 is identical to the timing of the input data DYI (B) shown in FIG. 4. Although FIGS. 3 and 4 should be put together in a drawing in chronological order, they are shown separately due to space limitations.

FIG. 3 shows the timing relationship among the following: the external signal YSCL, which is the first clock; the internal signal XINH, which is the second clock produced by halving a period of the external signal YSCL; the internal signal YSCL produced by performing the logical operation AND of the external signal YSCL and the internal signal XINH so as to remove every other clock of the external signal YSCL; the input data DYI (A) output from a SEG driver not shown in the drawing to the first COM driver Y10 in order to trigger the first COM driver Y10; the shift register outputs O1 to O60 that are sequentially output from the first COM driver Y10 as a consequence of comb-like driving; two periods of the internal output data DYO (A) provided as a consequence of comb-like driving of the first COM driver Y10; and the external output data DYO (A), which is output data obtained by turning two periods of the internal output data DYO (A) back to one period of data with the internal signal XINH in the same manner as the input data DYI (A). Here, the input data DYI (A), the shift register outputs O1 to O60, the internal output data DYO (A), and the external output data DYO (A) are low active signals.

FIG. 4 shows the timing relationship among the following: the external signal YSCL, which is the first clock; the internal signal YSCL produced by performing the logical operation AND of the external signal YSCL and the internal signal XINH so as to remove every other clock of the external signal YSCL; the input data DYI (B) output from the first COM driver Y10 in order to trigger the second COM driver Y20; the shift register outputs O1' to O60' that are sequentially output from the second COM driver Y20 as a consequence of comb-like driving; and two periods of the output data DYO (B) provided as a consequence of comb-like driving of the second COM driver Y20. Here, the input data DYI (B), the shift register outputs O1' to O60', and the output data DYO (B) are low active signals.

As FIGS. 3 and 4 show, when using multiple COM drivers for comb-like driving in cascade connection, the first COM driver Y10 for comb-like driving outputs one period of the external output data DYO (A). One period of the external output data DYO (A) is input to the second COM driver Y20 for comb-like driving without conversion as the input data DYI (B). As a result, the second COM driver Y20 in cascade connection operates normally.

Figure 5:
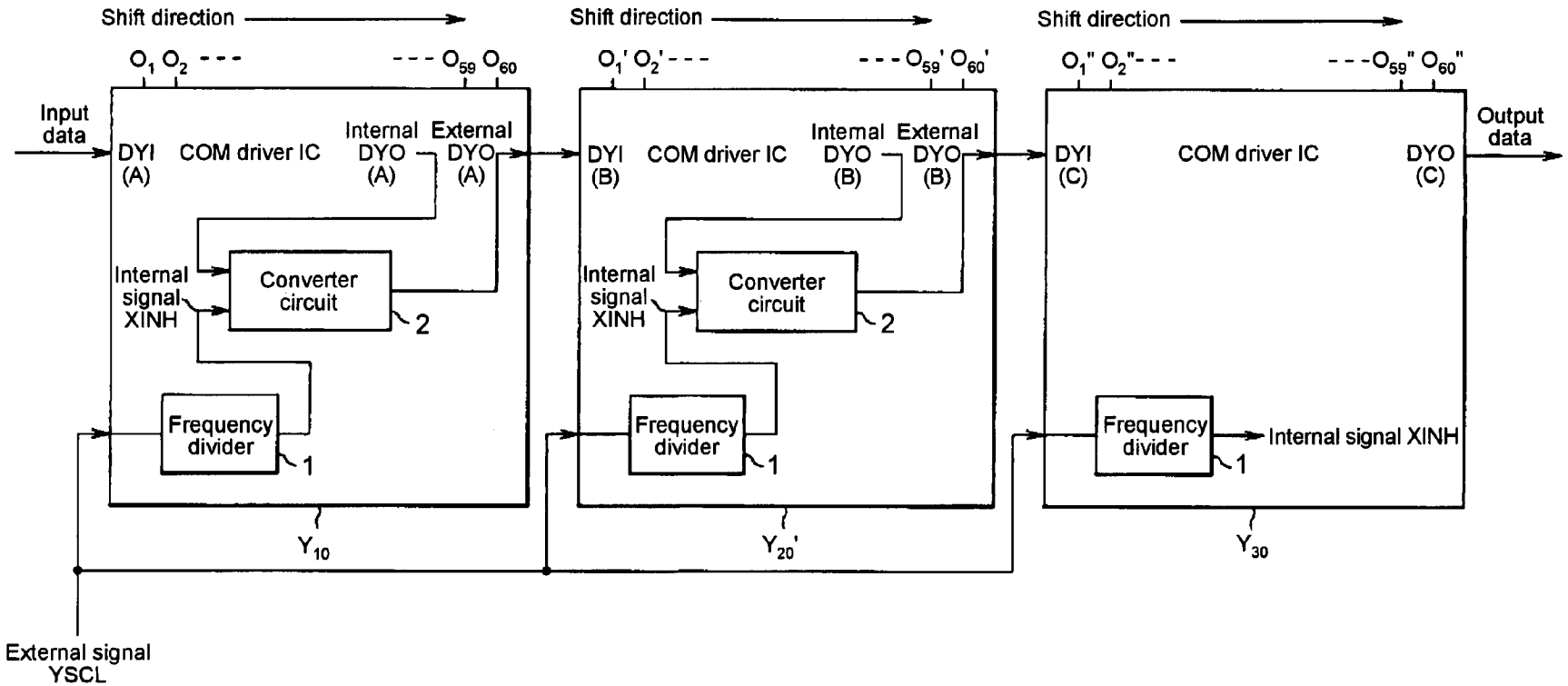
FIG. 5 is a block diagram showing a driver for a liquid crystal device according to an embodiment of the present invention.

FIG. 5 is a block diagram showing a driver for a liquid crystal device according to an embodiment of the present invention.

The driver for a liquid crystal device shown in FIG. 5 includes three COM drivers for comb-like driving in cascade connection. Parts used in this drawing that are the same as those in FIG. 1 are identified by the same reference number.

In FIG. 5, DYI (A), (B), and (C) represent the input data of the first COM driver Y10, a second COM driver Y20', and a last COM driver Y30, respectively, for comb-like driving. The internal output data DYO (A) and internal output data (B) are output data of two periods before being converted by the converter circuit 2 in the COM drivers Y10 and Y20', respectively, for comb-like driving. The external output data DYO (A) and external output data (B) are output data of one period after being converted by the converter circuit 2 in the COM drivers Y10 and Y20', respectively, for comb-like driving. External output data DYO (C) is output data of two periods output from the last COM driver Y30 for comb-like driving.

Each of the first, second, and last COM drivers Y10, Y20', and Y30 for comb-like driving includes a built-in shift register circuit (not shown in the drawing) having a predetermined number (sixty in the drawing) of flip-flops. More specifically, the first COM driver Y10 for comb-like driving includes sixty shift register outputs O1 to O60, the second COM driver Y20' for comb-like driving includes sixty shift register outputs O1' to O60', and the last COM driver Y30 for comb-like driving includes sixty shift register outputs O1" to O60".

Each of the first, second, and last COM drivers Y10, Y20', and Y30 for comb-like driving further includes the frequency divider 1. The frequency divider 1 receives the external signal YSCL, which is the first clock provided from outside for serving as a basis of driving the drivers, and produces the internal signal XINH, which is the second clock for interlaced driving, by halving a period of the external signal YSCL.

The first and second COM driver Y10 and Y20' for comb-like driving further include the converter circuit 2. The converter circuit 2 turns two periods of output data that are output in response to input data corresponding to one period of the external signal YSCL back to one period of output data with the internal signal XINH, which is the second clock.

In other words, when using multiple COM drivers for comb-like driving in cascade connection, this structure prevents the output data of each COM driver aside from the first and last ones from being passed to the following COM driver in a state that the time length of the output data is doubled to that of the input data. Therefore, not limited to the two-driver structure shown in FIG. 1 and the three-driver structure shown in FIG. 5, this can be applied to a structure with a plurality of COM drivers for comb-like driving having N COM drivers (N is a positive integer) in cascade connection. The inverter circuit 2 is not necessarily provided to the last COM driver. However, providing the inverter circuit 2 to the last COM driver makes it possible to use COM drivers of the same type alone.

Figure 6:
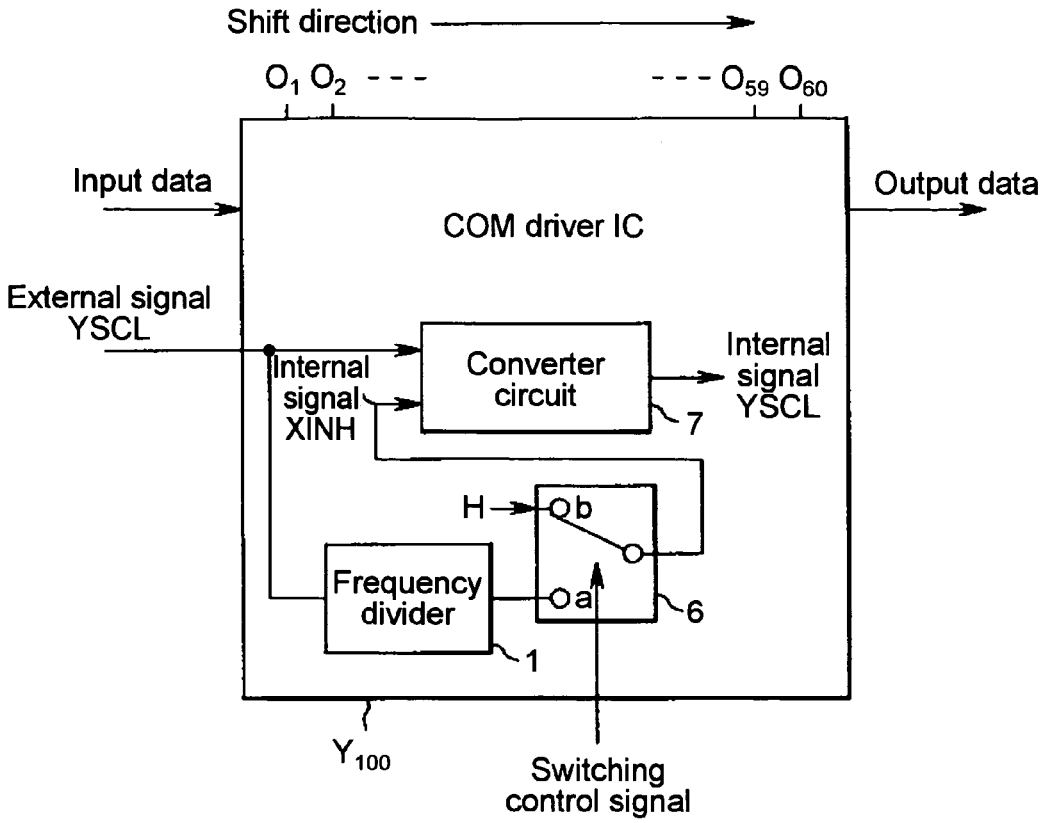
FIG. 6 is a block diagram showing a driver for a liquid crystal device capable of selecting either comb-like driving or consecutive driving according to an embodiment of the present invention.

FIG. 6 is a block diagram showing a driver for a liquid crystal device according to an embodiment of the present invention.

In the present embodiment, a method for driving a COM driver can be selected between comb-like driving, which conducts scanning alternately from right and left in a comb-like manner, and consecutive driving, which drives the driver consecutively. Otherwise, a COM driver for comb-like driving, which conducts scanning alternately from right and left in a comb-like manner, can be converted to conduct consecutive driving, which drives the driver consecutively.

A COM driver Y100 shown in FIG. 6 includes a COM driver having a built-in shift register circuit (not shown in the drawing) having a predetermined number (sixty in the drawing) of flip-flops. More specifically, the COM driver Y100 for comb-like driving includes sixty shift register outputs O1 to O60.

The COM driver Y100 for comb-like driving further includes the frequency divider 1. The frequency divider 1 receives the external signal YSCL, which is the first clock provided from outside for serving as a basis of driving the drivers, and produces the internal signal XINH, which is the second clock for interlaced driving, by halving a period of the external signal YSCL.

The COM driver Y100 for comb-like driving further includes a switching circuit 6 that receives the internal signal XINH (a clock obtained by halving a period of the external signal YSCL and whose duty time is shared by a high level (H) and a low level (L) fifty-fifty) for comb-like driving output from the frequency divider 1 at one input terminal "a", receives a constantly high level (H) signal as the internal signal XINH for consecutive driving at another input terminal "b", and switches the internal signal XINH for comb-like driving and the internal signal XINH for consecutive driving so as to output either one. Furthermore, the COM driver Y100 for comb-like driving includes a converter circuit 7 that receives the external signal YSCL and the internal signal XINH from the switching circuit 6, and outputs the internal signal YSCL depending on a switching control signal that is made based on the two received signals and indicating either comb-like driving or consecutive driving.

Figure 7:
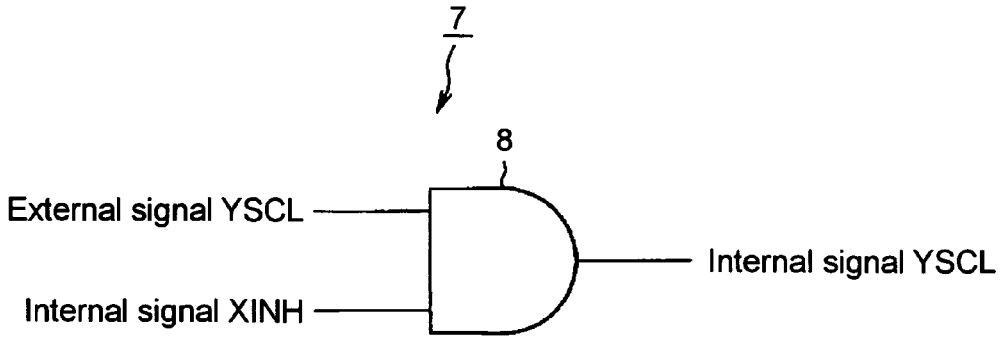
FIG. 7 is a logic circuit diagram illustrating an example of the structure of the converter circuit 7 shown in FIG. 6.

FIG. 7 shows an example of the structure of the converter circuit 7.

The converter circuit 7 performs logical operations by inputting the external signal YSCL, which is input from outside and serves as a basis for driving a driver, and the internal signal XINH output from the switching circuit 6 to an AND gate circuit 8. Consequently, the converter circuit 7 converts the external signal YSCL and the internal signal XINH to the internal signal YSCL (shown in FIGS. 8 and 9) required for comb-like driving or consecutive driving depending on an indicated driving method.

This structure makes it possible to select comb-like driving or consecutive driving only by additionally using simple circuits, for example, the switching circuit 6 and the AND gate circuit 8 as a converter circuit.

Figure 8:
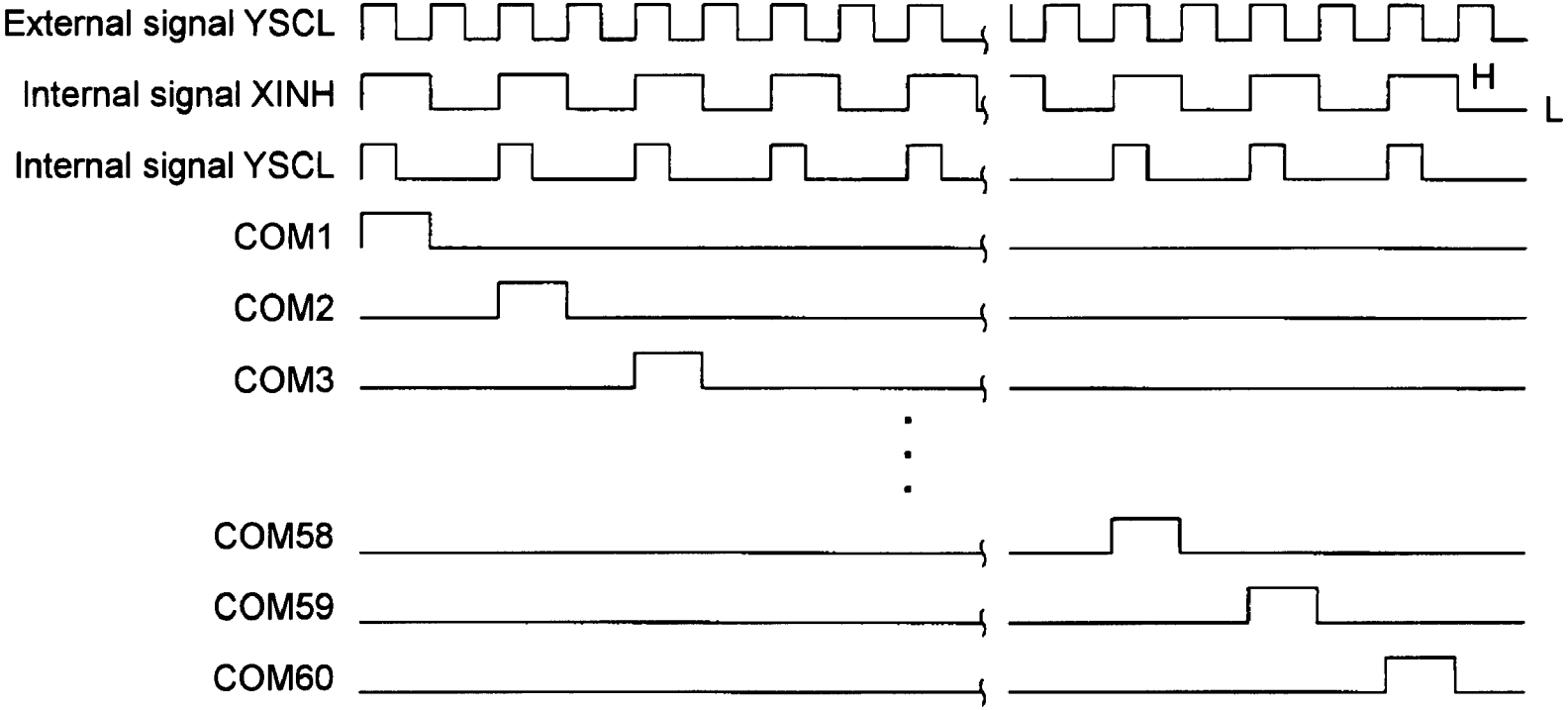
FIG. 8 is a timing chart of each signal of the COM driver Y100 shown in FIG. 6 in selecting comb-like driving.
Figure 9:
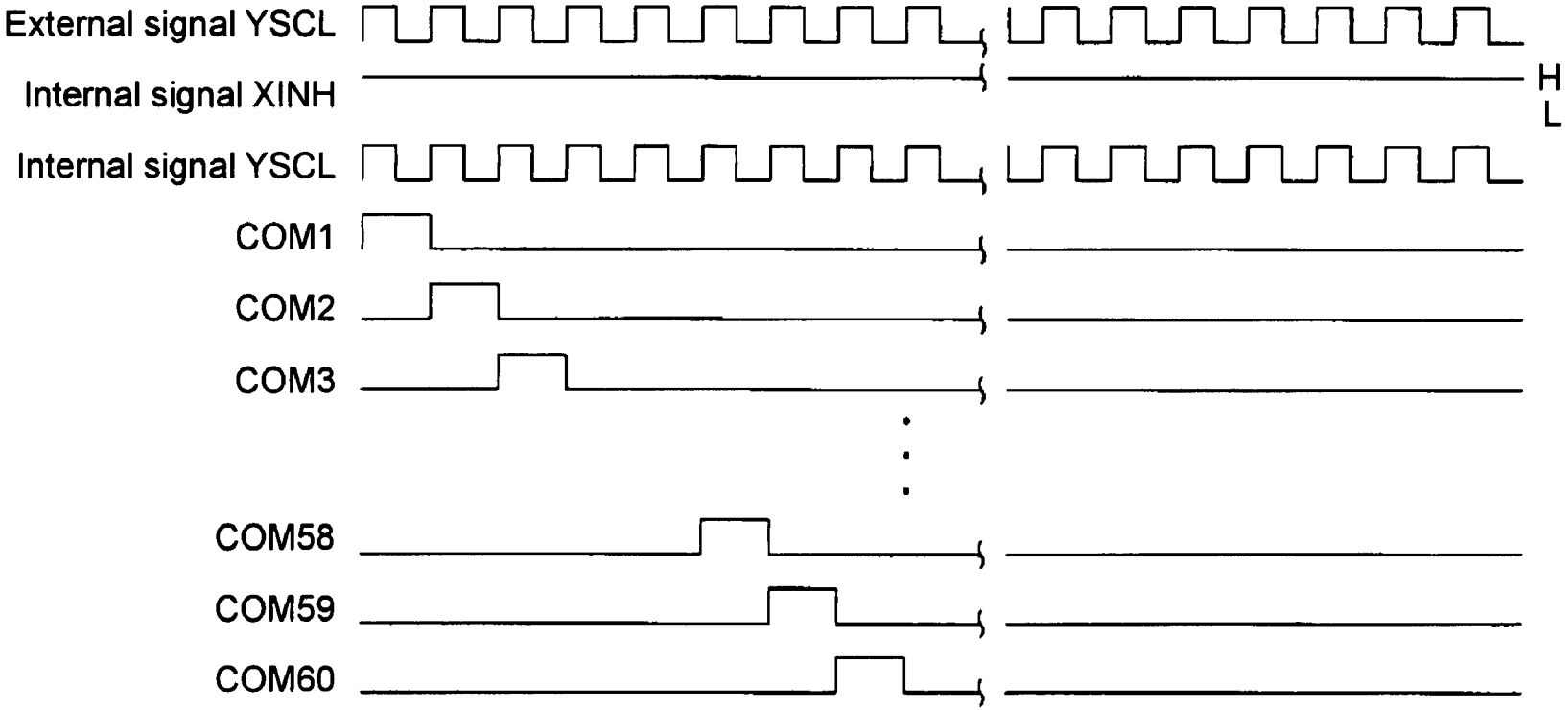
FIG. 9 is a timing chart of each signal of the COM driver Y100 in selecting consecutive driving.

FIG. 8 is a timing chart of each signal of the COM driver Y100 shown in FIG. 6 in selecting comb-like driving. FIG. 9 is a timing chart of each signal of the COM driver Y100 shown in FIG. 6 in selecting consecutive driving.

FIG. 8 shows the timing relationship in selecting comb-like driving among the following: the external signal YSCL, which is the first clock; the internal signal XINH, which is the second clock for interlaced driving produced by halving a period of the external signal YSCL; the internal signal YSCL, which is produced by performing the logical operation AND of the external signal YSCL and the internal signal XINH so as to remove every other clock of the external signal YSCL; and scanning data COM1 to COM 60 provided to each of the sixty common electrodes of an LCD panel in sync with the internal signal YSCL.

FIG. 9 shows the timing relationship in selecting consecutive driving among the following: the external signal YSCL, which is the first clock; the internal signal XINH for maintaining a high level (H) that is set for consecutive driving; the internal signal YSCL, which is produced by performing the logical operation AND of the external signal YSCL and the internal signal XINH, and is equal to the clock of the external signal YSCL; and the scanning data COM1 to COM 60 provided to each of the sixty common electrodes of an LCD panel in sync with the internal signal YSCL.

Moreover, it should be understood that the invention is not limited to the above-mentioned examples and embodiments, and is applicable to various modes within the range without departing from the spirit and scope of the invention.

As described above, the invention provides a method that can operate the second and following COM drivers normally in using multiple COM drivers for comb-like driving in cascade connection. As a result, it also reduces energy consumption in using the multiple COM drivers for comb-like driving in cascade connection.

What is claimed is:

1. A driver for a liquid crystal device comprising:

a plurality of common drivers having a first common driver and a last common driver for comb-like driving, coupled in cascade connection; and a means for turning a time length of output data back to a time length of input data regarding each of the common drivers for comb-like driving aside from the first common driver and the last common driver by using a second clock for interlaced driving that is obtained by halving a period of a first clock that serves as a basis of driving the drivers, wherein the means for converting output data comprises a circuit where the second clock for interlaced driving and two periods of the output data of each of the common drivers for comb-like driving are input and the circuit performs logical operations with these two inputs.

2. A driver for a liquid crystal device comprising:

a plurality of common drivers having a first common driver and a last common driver for comb-like driving, coupled in cascade connection; and a frequency driver that turns a time length of output data back to a time length of input data regarding each of the common drivers for comb-like driving aside from the first common driver and the last common driver by using a second clock for interlaced driving that is obtained by halving a period of a first clock that serves as a basis of driving the drivers, wherein the converter circuit comprises a circuit where the second clock for interlaced driving and two periods of the output data of each of the common drivers for comb-like driving are input and the circuit performs logical operations with these two inputs.

3. A driver for a liquid crystal device comprising:

a plurality of common drivers having a first common driver and a last common driver for comb-like driving, coupled in cascade connection;

a frequency driver that turns a time length of output data back to a time length of input data regarding each of the common drivers for comb-like driving aside from the first common driver and the last common driver by using a second clock for interlaced driving that is obtained by halving a period of a first clock that serves as a basis of driving the drivers; and a converter circuit that converts two periods of output data that are output in response to input data corresponding to one period of the first clock into one period of output data by using the second clock regarding input and output data of each of the common drivers for comb-like driving.

4. The driver for a liquid crystal device according to claim 3, wherein the converter circuit comprises a circuit where the second clock for interlaced driving and two periods of the output data of each of the common drivers for comb-like driving are input and the circuit performs logical operations with these two inputs.

5. A driver for a liquid crystal device comprising:

a plurality of common drivers having a first common driver and a last common driver for comb-like driving, coupled in cascade connection;

a means for turning a time length of output data back to a time length of input data regarding each of the common drivers for comb-like driving aside from the first common driver and the last common driver by using a second clock for interlaced driving that is obtained by halving a period of a first clock that serves as a basis of driving the drivers; and a means for converting two periods of output data that are output in response to input data corresponding to one period of the first clock into one period of output data by using the second clock regarding input and output data of each of the common drivers for comb-like driving, wherein the means for converting output data comprises a circuit where the second clock for interlaced driving and two periods of the output data of each of the common drivers for comb-like driving are input and the circuit performs logical operations with these two inputs.

6. A method of driving a driver for a liquid crystal device comprising:

coupling in a cascade connection, a plurality of common drivers having a first common driver and a last common driver for comb-like driving;

producing a second clock for interlaced driving by halving a period of a first clock that is provided from outside for serving as a basis of driving the drivers regarding each of the common drivers for comb-like driving aside from the first common driver and the last common driver;

converting two periods of output data that are output in response to input data corresponding to one period of the first clock into one period of output data by using the second clock regarding input and output data of each of the common drivers for comb-like driving; and providing a circuit where the second clock for interlaced driving and two periods of the output data of each of the common drivers for comb-like driving are input and the circuit performs logical operations with these two inputs.

* * * * *